US009330550B2

(12) United States Patent
Zribi et al.

(10) Patent No.: US 9,330,550 B2
(45) Date of Patent: May 3, 2016

(54) LOW NUISANCE FAST RESPONSE HAZARD ALARM

(71) Applicant: WALTER KIDDE PORTABLE EQUIPMENT, INC., Mebane, NC (US)

(72) Inventors: Anis Zribi, Colorado Springs, CO (US); Bill Chandler, Colorado Springs, CO (US); Matthew J. Buchholz, Colorado Springs, CO (US); Dave Bush, Wheatland, WY (US)

(73) Assignee: WALTER KIDDE PORTABLE EQUIPMENT, INC., Mebane, NC (US)

( * ) Notice: Subject to any disclaimer, the term of this patent is extended or adjusted under 35 U.S.C. 154(b) by 82 days.

(21) Appl. No.: 13/893,081

(22) Filed: May 13, 2013

(65) Prior Publication Data

US 2014/0015678 A1 Jan. 16, 2014

Related U.S. Application Data

(60) Provisional application No. 61/671,524, filed on Jul. 13, 2012.

(51) Int. Cl.

| | |
|---|---|
| ***G08B 17/00*** | (2006.01) |
| ***G08B 17/10*** | (2006.01) |
| ***G08B 29/18*** | (2006.01) |
| ***G08B 29/26*** | (2006.01) |

(52) U.S. Cl.

CPC ..... *G08B 17/00* (2013.01); *G08B 17/10* (2013.01); *G08B 29/183* (2013.01); *G08B 29/26* (2013.01); *G08B 29/185* (2013.01)

(58) Field of Classification Search

CPC ..... G08B 17/10; G08B 17/00; G08B 29/183
USPC ..... 340/589, 628, 693.6
See application file for complete search history.

(56) References Cited

U.S. PATENT DOCUMENTS

| | | | | |
|---|---|---|---|---|
| 4,871,999 | A | 10/1989 | Ishii et al. | |
| 5,260,687 | A | 11/1993 | Yamauchi et al. | |
| 6,046,452 | A | 4/2000 | Castleman et al. | |
| 6,064,064 | A | 5/2000 | Castleman | |
| 6,078,050 | A | 6/2000 | Castleman | |
| 6,144,310 | A | 11/2000 | Morris | |
| 6,154,142 | A * | 11/2000 | Kosugi et al. | 340/589 |
| 6,323,780 | B1 | 11/2001 | Morris | |
| 6,437,698 | B1 * | 8/2002 | Byrne | G08B 3/10 340/588 |
| 6,445,292 | B1 | 9/2002 | Jen et al. | |
| 6,515,283 | B1 | 2/2003 | Castleman et al. | |
| 6,518,574 | B1 | 2/2003 | Castleman | |
| 6,600,424 | B1 | 7/2003 | Morris | |
| 6,897,774 | B2 | 5/2005 | Costa et al. | |
| 6,915,011 | B2 * | 7/2005 | Loui et al. | 382/224 |
| 6,927,394 | B2 | 8/2005 | Parham et al. | |

(Continued)

FOREIGN PATENT DOCUMENTS

| | | | |
|---|---|---|---|
| WO | 9732288 | A1 | 9/1997 |
| WO | 9805014 | A1 | 2/1998 |

(Continued)

*Primary Examiner* — Mohamed Barakat
(74) *Attorney, Agent, or Firm* — Cantor Colburn LLP

(57) ABSTRACT

Embodiments relate to systems for, and methods of, providing low nuisance, fast response hazard notification. Advantageously, the disclosed techniques avoid sounding an alarm in response to typical nuisance events, such as burnt food.

13 Claims, 2 Drawing Sheets

(56) References Cited

U.S. PATENT DOCUMENTS

| | | | | |
|---|---|---|---|---|
| 7,034,703 | B2 | 4/2006 | Morris | |
| 7,158,040 | B2 | 1/2007 | Morris | |
| 7,170,418 | B2 | 1/2007 | Rose-Pehrsson et al. | |
| 7,202,794 | B2 | 4/2007 | Shubinsky et al. | |
| 7,221,260 | B2 | 5/2007 | Berezowski et al. | |
| 7,327,247 | B2 | 2/2008 | Tice | |
| 7,642,924 | B2 * | 1/2010 | Andres et al. | 340/628 |
| 8,035,527 | B2 | 10/2011 | Powell | |
| 8,294,567 | B1 * | 10/2012 | Stell | 340/522 |
| 2002/0011570 | A1 | 1/2002 | Castleman | |
| 2009/0045937 | A1 | 2/2009 | Zimmerman | |
| 2011/0057801 | A1 | 3/2011 | Logan et al. | |
| 2012/0025994 | A1 | 2/2012 | Morris | |
| 2012/0212346 | A1 * | 8/2012 | Conforti | 340/628 |

FOREIGN PATENT DOCUMENTS

| | | | |
|---|---|---|---|
| WO | 0022591 | A1 | 4/2000 |
| WO | 0043968 | A1 | 7/2000 |
| WO | 0180194 | A2 | 10/2001 |
| WO | 2005052873 | A2 | 6/2005 |
| WO | 2006019436 | A1 | 2/2006 |
| WO | 2006057694 | A2 | 6/2006 |
| WO | 2007028939 | A1 | 3/2007 |

* cited by examiner

LOW NUISANCE FAST RESPONSE HAZARD ALARM

PRIORITY

The present application claims priority to U.S. Provisional Patent Application No. 61/671,524, filed Jul. 13, 2012, and entitled "LOW NUISANCE FAST RESPONSE HAZARD ALARM", the contents of which are hereby incorporated by reference in its entirety.

SUMMARY

According to various embodiments, a hazard safety device is disclosed. The hazard safety device can include an electronic processor and a smoke sensor communicatively coupled to the processor, where the smoke sensor is configured to produce a smoke sensor signal. The hazard safety device can further include a temperature sensor communicatively coupled to the processor, where the temperature sensor is configured to produce a temperature sensor signal. The processor can be configured to increase a smoke sensor signal threshold from a first smoke sensor signal threshold value to a second smoke sensor signal threshold value in response to a combination of parameter values comprising a smoke sensor signal value of at least the first smoke sensor signal threshold value, a rate of change of the smoke sensor signal below a smoke sensor rate of change threshold, and a rate of change of the temperature sensor signal below a temperature sensor rate of change threshold.

DESCRIPTION OF DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Figure 1:
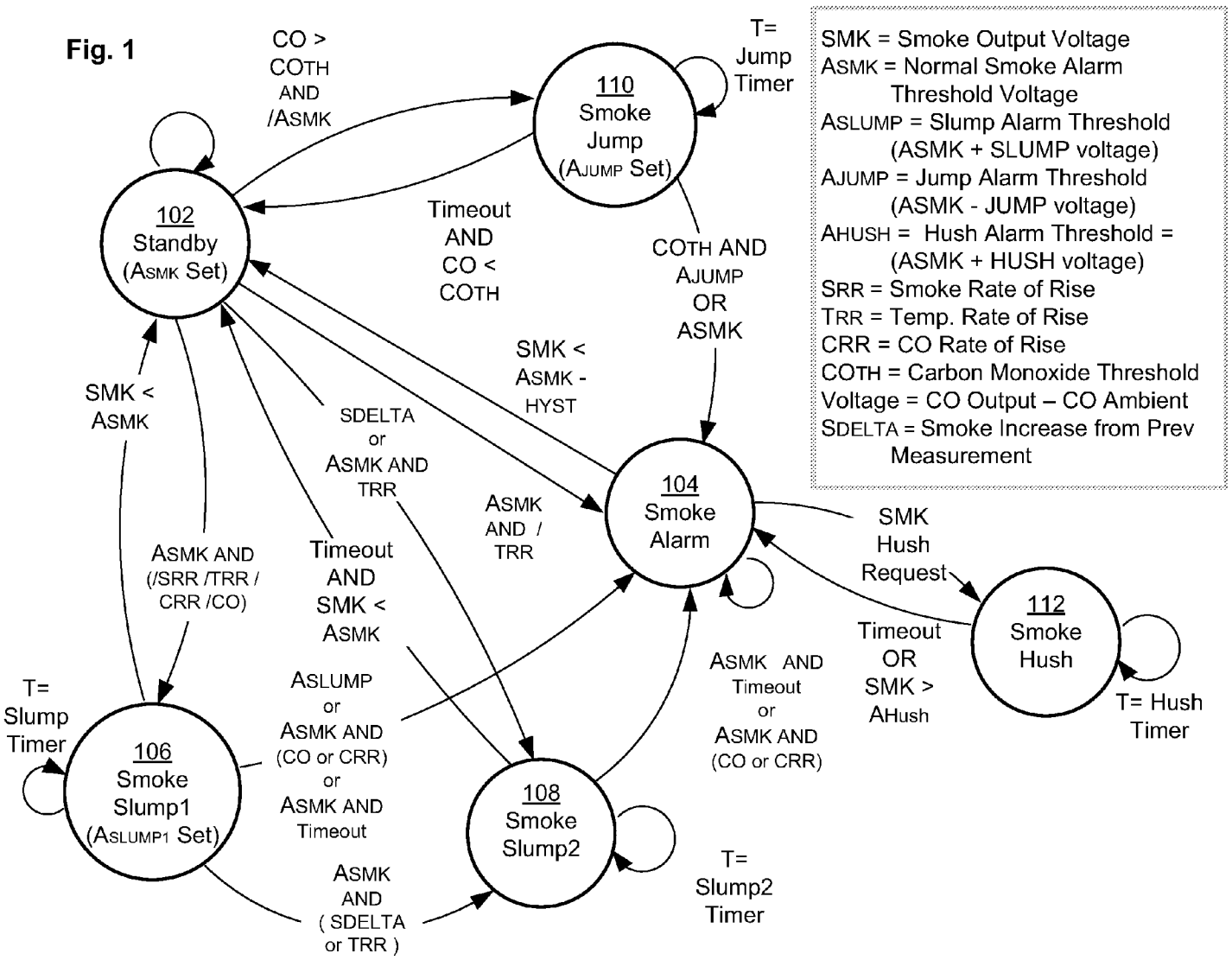
FIG. 1 is a schematic state diagram according to various embodiments.

Various embodiments of the invention include a hazard safety device. The hazard safety device can include one or more sensors. In some embodiments, the hazard safety device includes a smoke (e.g., optical particulate) sensor, a temperature sensor, and a carbon monoxide sensor. Some embodiments include multiple smoke sensors (e.g., optical particulate and ion). Each sensor produces an output signal having a property (e.g., current, voltage, frequency, or modulation) that correlates with the sensed smoke (SMK), temperature (T), and carbon monoxide levels (CO), respectively. When multiple smoke sensors are used, their outputs can be combined into a single signal correlated with sensed smoke. The output signals, if analog, can be quantized using one or more analog-to-digital converters. The sensor outputs can be sampled at a known rate, e.g., anywhere from ten times per second to once every ten seconds. The hazard safety device also includes a processor, which is communicatively coupled to the sensors. The processor can be, for example, a microcontroller. The processor can also be configured to calculate one or more of: a temperature sensor signal rate of rise (TRR), a smoke sensor signal rate of rise (SRR), and a carbon monoxide sensor signal rate of rise (CRR). The processor can also be configured to calculate an amount of change for any parameter between temporally adjacent samples, i.e., from one sample to the next.

Embodiments utilize threshold values of particular sensor signal outputs at particular times in order to decide whether to issue an alarm (e.g., audible, visual or both). More particularly, embodiments can utilize computer learning techniques to determine whether a particular set of sensor outputs over time indicate a real, potentially dangerous fire, or a nuisance event, such as a smoke from burnt pork chop or the presence of a cloud of hairspray. The computer learning techniques can be implemented by obtaining many (e.g., dozens, hundreds, or more) test fire profiles, from which disclosed techniques can obtain sensor readings and rates of change for dangerous fires and nuisance events. Each such sensor profile is classified as corresponding to either a dangerous fire or a nuisance event. This set of data, referred to herein as "training data", is then fed to a computer learning technique such as a discriminant model (e.g., a linear discriminant model) or a support vector machine. Once the computer learning technique is trained according to the training data, it is capable of classifying novel sets of sensor data as likely corresponding to a dangerous fire or a nuisance event. Moreover, the computer learning algorithms can be used to determine appropriate thresholds to be implemented in the state diagrams discussed below. Note that such computer learning techniques can be conceptualized as altering thresholds of some parameters based on values of other parameters. That is, machine learning techniques can take into account multiple parameters (sensor output values and rates of change thereof) simultaneously, and certain values for some such parameters can effectively lower thresholds for other such parameters, thus causing a change in classification.

FIG. 1 is a schematic state diagram according to various embodiments. Standby state 102 represents the normal rest state of various hazard safety device implementations. In standby state 102, the device samples each sensor's output at a given rate. In some embodiments, the threshold for the smoke sensor, Asmk, is set according to a computer learning algorithm. In some embodiments, Asmk is a normal calibrated alarm threshold, which can be determined by a targeted smoke sensitivity (defined through test data) and execution of a calibration equation to meet that target. The threshold for the carbon monoxide sensor COth is set according to a computer learning algorithm, but is also affected by the average ambient levels of carbon monoxide present. The average ambient level of carbon monoxide, COamb, can be determined using a time-weighted average. Thus, the carbon monoxide threshold COth is considered to have been exceeded if the carbon monoxide sensor signal CO exceeds COth plus the average ambient carbon monoxide COamb. If, during standby state 102, the output CO from the carbon monoxide sensor is found to exceed COth (as modified by the ambient carbon monoxide level), but the output SMK from the smoke sensor does not exceed Asmk, then control passes to Smoke Jump State 110.

At smoke jump state 110, the threshold for the smoke sensor is reset from Asmk to Ajump, which is lower than Asmk. Furthermore, initiation of smoke jump state 110 causes a timer to initiate. The timer can be set to expire anywhere from, for example, 1 to 10 minutes. If, upon expiration of the timer, the sensed carbon monoxide is less than the associated carbon monoxide threshold (CO<COth), then control returns to standby state 102. If, during the timer's run, either (1) CO>COth and SMK>Ajump, or (2) SMK>Asmk, then control passes to alarm state 104.

Alarm state 104 causes the device to issue an alarm, which can be audible, visual, or both. Once in alarm state 104, the device remains in alarm state 104 until one of the predetermined transition conditions discussed herein occurs.

Some embodiments include a hush control, e.g., a button. In such embodiments, a user can activate the hush button while the device is in alarm state 104. Doing so causes control to pass to hush state 112 and the smoke sensor threshold to be reset to Ahush, which is greater than both Asmk and Aslump. Initiation of hush state 112 causes a timer to initiate. The timer can be set to expire anywhere from, for example, 5-20 minutes. If either (1) the timer expires, or (2) SMK>Ahush, then control returns to alarm state 104. The threshold Ahush can be determined using computer learning techniques as discussed above.

If, during standby state 102, SMK>Asmk, carbon monoxide level CO is less than the carbon monoxide sensor signal threshold COth, and the smoke sensor signal rate of change, the temperate sensor signal rate of change, and the carbon monoxide sensor signal rate of change are all less than their respective predetermined thresholds, then control passes to first smoke slump state 106.

At first smoke slump state 106, the threshold for the smoke sensor is reset from Asmk to Aslump1, which is higher than Asmk. Furthermore, initiation of first smoke slump state 106 causes a timer to initiate. The timer can be set to expire anywhere from, for example, 5 to 15 minutes. If, upon expiration of the timer, SMK<Asmk, then control returns to standby state 102. If, upon expiration of the timer, SMK>Asmk, then control passes to alarm state 104. Further, if, prior to expiration of the timer, SMK>Aslump, then control passes to alarm state 104. If, prior to expiration of the timer, SMK>Asmk and either (1) CO>COth, or (2) the carbon monoxide rate of rise CRR exceeds the carbon monoxide rate of rise threshold CRRth, then control passes to alarm state 104. If, prior to expiration of the timer, SMK>Asmk and either (1) the temperature rate of rise exceeds the temperature rate of rise threshold, or (2) the smoke sensor signal output between adjacent time samples exceeds the corresponding threshold, denoted Sdelta, then control passes to second smoke slump state 108.

Initiation of second smoke slump state 108 causes a timer to initiate. The timer can be set to expire anywhere from, for example, 1 second to 1 minute. If, upon expiration of the timer, SMK>Asmk, then control passes to alarm state 104. If, prior to expiration of the timer, both SMK>Asmk, and either (1) CO>COth, or (2) the carbon monoxide rate of rise CRR exceeds the carbon monoxide rate of rise threshold CRRth, then control passes to alarm state 104. If, upon expiration of the timer, SMK<Asmk, then control returns to standby state 102.

Control passes directly from standby state 102 to second slump state 108 if the smoke sensor signal SMK increases by a predetermined threshold amount Sdelta between temporally adjacent samples. Similarly, control can pass from standby state 102 to second slump state 108 if the smoke sensor signal SMK exceeds the smoke sensor signal threshold (SMK>Asmk) and the temperature rate of rise TRR exceeds a predetermined threshold TRRth.

Control passes directly from standby state 102 to alarm state 104 if the smoke sensor signal SMK exceeds the smoke sensor signal threshold (SMK>Asmk), but the temperature rate of rise TRR does not exceed a predetermined threshold. Control returns from alarm state 104 to standby state 102 if the smoke sensor signal SMK is less than the smokes sensor signal threshold minus a hysteresis term HYST, i.e., if SMK<Asmk−HYST.

Some embodiments omit second slump state 108. In these and certain other embodiments, when in standby state 102, if the smoke sensor signal SMK exceeds the smoke sensor signal threshold (SMK>Asmk), and none of the conditions that would otherwise pass control to first smoke slump state 106 are met, then control passes directly to alarm state 104.

Figure 2:
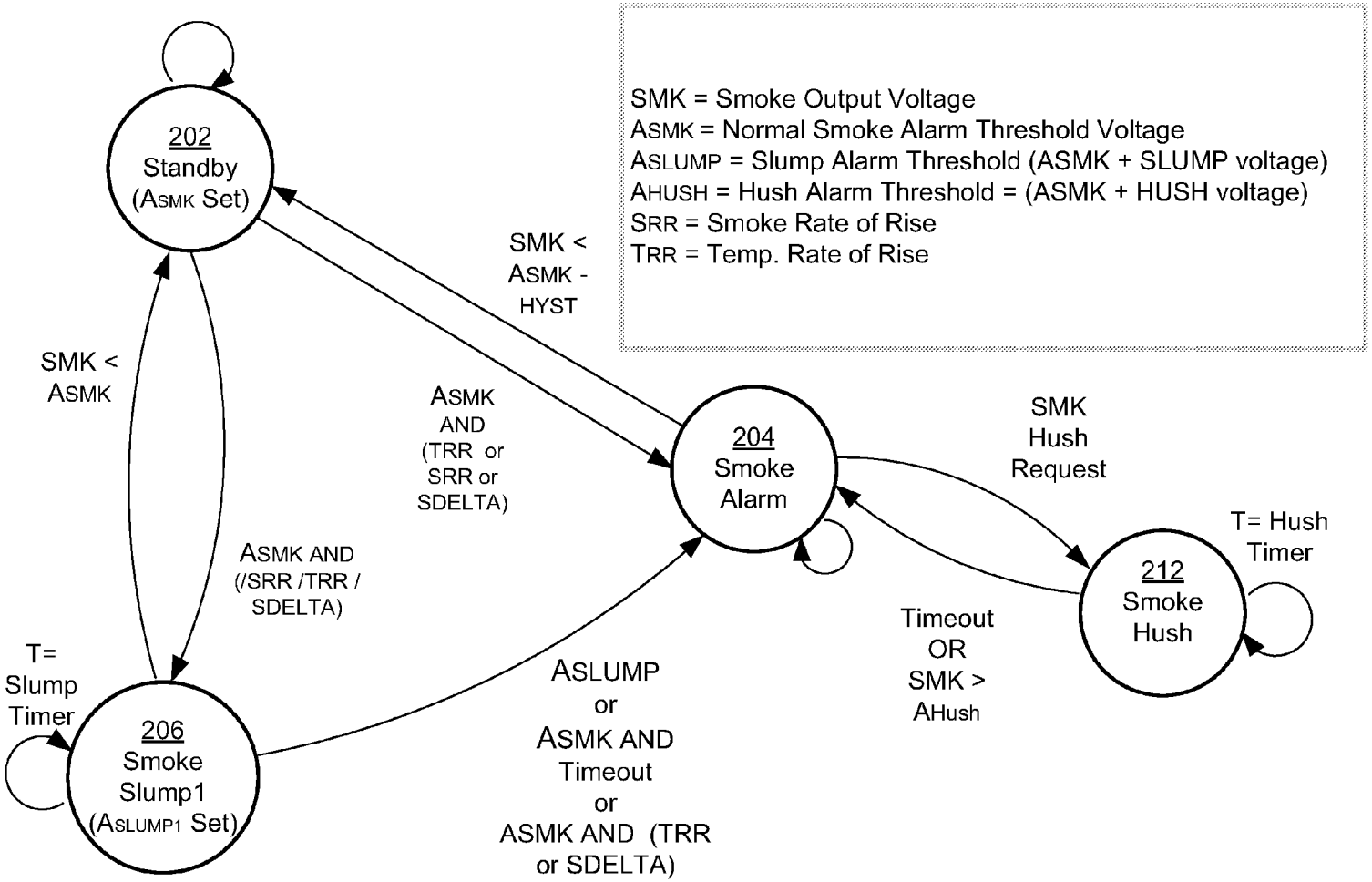
FIG. 2 is a schematic state diagram according to various embodiments.

FIG. 2 is a schematic state diagram according to various embodiments. Standby state 202 represents the normal rest state of various hazard safety device implementations and is similar to standby state 102 of FIG. 1 in that the device samples various sensor output signals and transitions to other states accordingly. Embodiments that implement the state diagram of FIG. 2 include a smoke sensor and a temperature sensor, but need not include a carbon monoxide sensor (although FIG. 2 does embrace embodiments that include a carbon monoxide sensor or any other sensor in addition to the smoke sensor and the temperature sensor).

If, at standby state 202, the smoke sensor signal SMK exceeds the smoke sensor threshold Asmk, and none of the smoke sensor rate of rise SRR, the temperature sensor rate of rise TRR and the smoke sensor increase between temporally adjacent samplings Sdelta exceed their respective thresholds (SRRth, TRRth and Sdelthth, respectively), then the state transitions to slump state 206. Once in slump state 206, if SMK<Asmk, then control returns to standby state 202. If, when in standby state 202, the smokes sensor signal exceeds the smoke sensor threshold (SMK>Asmk), and if any of (1) the temperature rate of rise TRR exceeds the temperature rate of rise threshold TRRth, or (2) the smokes sensor rate of rise SRR exceeds the smoke sensor rate of rise threshold SRRth, or (3) the smoke sensor increase between temporally adjacent samplings Sdelta exceeds its threshold Sdeltath, then control transitions to alarm state 204.

Initialization of slump state 206 initiates a timer. The timer can be set to expire anywhere from, for example, 5-15 minutes. If, upon expiration of the timer, SMK>Asmk, then control transitions to alarm state 204. If at any time in slump state 206, SMK>Aslump, then control passes to alarm state 204. If at any time in slump state 206, SMK>Asmk and either (1) the temperature rate of rise TRR exceeds the threshold temperature rate of rise TRRth, or (2) the smoke sensor increase between temporally adjacent samplings Sdelta exceeds its threshold Sdeltath, then control transitions to alarm state 204.

Alarm state 204 causes the device to issue an alarm, which can be audible, visual, or both. Once in alarm state 204, the device remains in alarm state until one of the predetermined transition conditions discussed herein occurs. Thus, control returns from alarm state 204 to standby state 202 if the smoke sensor signal SMK is less than the smoke sensor signal threshold Asmk minus a hysteresis term HYST, i.e., if SMK<Asmk−HYST.

Some embodiments include a hush control, e.g., button. In such embodiments, a user can activate the hush button while the device is in alarm state 204. Doing so causes control to pass to hush state 212. Initiation of hush state 212 causes a timer to initiate. The timer can be set to expire anywhere from, for example, 5-20 minutes. If either (1) the timer expires, or (2) SMK>Ahush, then control returns to alarm state 204. The threshold Ahush can be determined using computer learning techniques as discussed above.

Note that any of the thresholds discussed herein can be obtained using computer learning techniques as discussed. In particular, training data classified as either nuisance events and dangerous fires can be utilized to determine appropriate threshold values.

Furthermore, the inequalities discussed herein are exemplary at least in the sense that when the compared quantities are equal, then either control can transition as discussed, or control can remain at a present state until the compared quantities are not equal as depicted in the relevant inequality. In other words, embodiments can transition, or not transition, in the event of an equality between quantities as discussed herein.

Voltages, currents, frequency, modulation, or other correlative properties of the signals from the sensors discussed herein are considered to increase as the presence of the relevant physical chemicals or properties increase. However, the invention is not so limited; some sensor signal properties can decrease as the presence of the relevant physical chemicals or properties increase. Altering embodiments to account for such modifications is both possible and contemplated.

The foregoing description is illustrative, and variations in configuration and implementation may occur to persons skilled in the art. Other resources described as singular or integrated can in embodiments be plural or distributed, and resources described as multiple or distributed can in embodiments be combined. The scope of the present teachings is accordingly intended to be limited only by the following claims.

What is claimed is:

1. A hazard safety device comprising:

an electronic processor;

at least one smoke sensor communicatively coupled to the processor, wherein the at least one smoke sensor is configured to produce a smoke sensor signal;

a temperature sensor communicatively coupled to the processor, wherein the temperature sensor is configured to produce a temperature sensor signal;

wherein the processor is configured to increase a smoke sensor signal threshold from a first smoke sensor signal threshold in a standby state to a second smoke sensor signal threshold in a first smoke slump state, wherein increasing the smoke sensor signal threshold from the first smoke sensor signal threshold to the second smoke sensor signal threshold occurs in response to a combination of at least (i) the smoke sensor signal above the first smoke sensor signal threshold, (ii) a calculated rate of change of the smoke sensor signal below a smoke sensor rate of change threshold, and (iii) a calculated rate of change of the temperature sensor signal below a temperature sensor rate of change threshold;

wherein the processor is configured to increase the smoke sensor signal threshold from the first smoke sensor signal threshold in the standby state to a further smoke sensor signal threshold in a second smoke slump state in response to:

a) a combination of (i) the smoke sensor signal above the first smoke sensor signal threshold and (ii) the calculated rate of change of the temperature sensor signal above the temperature sensor rate of change threshold;

b) a difference between smoke sensor signals for adjacent time samples exceeding a temporally adjacent smoke sensor sample difference threshold.

2. The hazard safety device of claim 1, further comprising a timer, wherein the processor is further configured to start the timer upon the increase of the smoke sensor signal threshold from the first smoke sensor signal threshold to the second smoke sensor signal threshold, and wherein the processor is configured to decrease the smoke sensor signal threshold from the second smoke sensor signal threshold to the first smoke sensor signal threshold upon both expiration of the timer and the smoke sensor signal below the first smoke sensor signal threshold.

3. The hazard safety device of claim 1, further comprising a carbon monoxide sensor communicatively coupled to the processor, wherein the carbon monoxide sensor is configured to produce a carbon monoxide sensor signal, and wherein the increase from the first smoke sensor signal threshold to the second smoke sensor signal threshold is further in response to the carbon monoxide sensor signal below a carbon monoxide sensor signal threshold and a calculated rate of change of the carbon monoxide sensor signal below a carbon monoxide sensor rate of change threshold.

4. The hazard safety device of claim 1 further comprising a carbon monoxide sensor communicatively coupled to the processor, wherein the carbon monoxide sensor is configured to produce a carbon monoxide sensor signal, and wherein the processor is configured to decrease the smoke sensor signal threshold from the first smoke sensor signal threshold to a third smoke sensor signal threshold in response to the smoke sensor signal below the first smoke sensor signal threshold and the carbon monoxide sensor signal above a carbon monoxide sensor signal threshold.

5. The hazard safety device of claim 4, further comprising a timer, wherein the processor is further configured to start the timer upon the decrease of the smoke sensor signal threshold from the first smoke sensor signal threshold to the third smoke sensor signal threshold, and wherein the processor is configured to increase the smoke sensor signal threshold from the third smoke sensor signal threshold to the first smoke sensor signal threshold upon both expiration of the timer and the carbon monoxide sensor signal below the carbon monoxide sensor signal threshold.

6. The hazard safety device of claim 5, wherein the processor is configured to issue an alarm prior to expiration of the timer in response to the carbon monoxide signal above the carbon monoxide sensor signal threshold, and the smoke sensor signal above the third smoke sensor signal threshold.

7. A method comprising:

obtaining a smoke sensor signal from at least one smoke sensor;

obtaining a temperature sensor signal from a temperature sensor; and increasing a smoke sensor signal threshold from a first smoke sensor signal threshold in a standby state to a second smoke sensor signal threshold in a first smoke slump state, wherein increasing the smoke sensor signal threshold from the first smoke sensor signal threshold to the second smoke sensor signal threshold occurs in response to a combination of at least (i) the smoke sensor signal above the first smoke sensor signal threshold, (ii) a calculated rate of change of the smoke sensor signal below a smoke sensor rate of change threshold, and (iii) a calculated rate of change of the temperature sensor signal below a temperature sensor rate of change threshold; and increasing the smoke sensor signal threshold from the first smoke sensor signal threshold in the standby state to a further smoke sensor signal threshold in a second smoke slump state in response to:

a) a combination of (i) the smoke sensor signal above the first smoke sensor signal threshold and (ii) the calculated rate of change of the temperature sensor signal above the temperature sensor rate of change threshold;

b) a difference between smoke sensor signals for adjacent time samples exceeding a temporally adjacent smoke sensor sample difference threshold.

8. The method of claim 7, further comprising:

starting a timer upon the increase of the smoke sensor signal threshold from the first smoke sensor signal threshold to the second smoke sensor signal threshold; and decreasing the smoke sensor signal threshold from the second smoke sensor signal threshold to the first smoke sensor signal threshold upon both expiration of the timer and the smoke sensor signal falling below the first smoke sensor signal threshold.

9. The method of claim 8, further comprising: issuing an alarm prior to expiration of the timer in response to the smoke sensor signal rising above the second smoke sensor signal threshold.

10. The method of claim 7, further comprising:

obtaining a carbon monoxide sensor signal from a carbon monoxide sensor; and obtaining a calculated rate of change of the carbon monoxide sensor signal;

wherein increasing the smoke sensor signal threshold from the first smoke sensor signal threshold to the second smoke sensor signal threshold is further in response to the carbon monoxide sensor signal falling below a carbon monoxide sensor signal threshold and the calculated rate of change of the carbon monoxide sensor signal falling below a carbon monoxide sensor rate of change threshold.

11. The method of claim 7, further comprising:

obtaining a carbon monoxide sensor signal from a carbon monoxide sensor; and decreasing the smoke sensor signal threshold from the first smoke sensor signal threshold to a third smoke sensor signal threshold in response to the smoke sensor signal falling below the first smoke sensor signal threshold and the carbon monoxide sensor signal rising above a carbon monoxide sensor signal threshold.

12. The method of claim 11, further comprising: starting a timer upon the decreasing of the smoke sensor signal threshold from the first smoke sensor signal threshold to the third smoke sensor signal threshold; and increasing the smoke sensor signal threshold from the third smoke sensor signal threshold to the first smoke sensor signal threshold upon both expiration of the timer and the carbon monoxide sensor signal falling below the carbon monoxide sensor signal threshold.

13. The method of claim 12, further comprising:

issuing an alarm prior to expiration of the timer in response to the carbon monoxide signal rising above the carbon monoxide sensor signal threshold, and the smoke sensor signal rising above the third smoke sensor signal threshold.

* * * * *